US005522748A

United States Patent [19]

Cressi

[11] Patent Number: 5,522,748

[45] Date of Patent: Jun. 4, 1996

[54] FLIPPER FOR SWIMMING AND PRODUCTION METHOD

[75] Inventor: Leopoldo A. Cressi, Genoa, Italy

[73] Assignee: Cressi Sub S.P.A., Genoa, Italy

[21] Appl. No.: 446,076

[22] Filed: May 19, 1995

[30] Foreign Application Priority Data

Jul. 1, 1994 [IT] Italy ..... FI94A0133

[51] Int. Cl.[6] ..... A63B 31/11

[52] U.S. Cl. ..... 441/64; 441/61

[58] Field of Search ..... D21/239; 441/61–64

[56] References Cited

U.S. PATENT DOCUMENTS 3,922,741 12/1975 Semeia ..... 441/64
4,954,111 9/1990 Cressi ..... 441/64
4,954,112 9/1990 Negrini et al. ..... 441/64

FOREIGN PATENT DOCUMENTS 2332038 6/1977 France ..... 441/64
9322004 11/1993 WIPO ..... 441/64

*Primary Examiner*—Edwin L. Swinehart
*Attorney, Agent, or Firm*—Browdy and Neimark

[57] ABSTRACT

A method for the production of a flipper for swimming by injection molding that provides for the production first, of the fin (1) with one flat bent end (1*a*), then the molding on it of an intermediate element (2) comprising a substantially flat part (2*a*) overlapping the bent end and from which develop a substantially arcuate part (2*b*) over it and a forked part (2*c*) forming two ribs (3), each of which is located both above and below the fin along its lateral edges. Finally, a shoe (5) is molded onto said intermediate element which lines the internal faces of the flat part and the arcuate part.

5 Claims, 4 Drawing Sheets

FLIPPER FOR SWIMMING AND PRODUCTION METHOD

FIELD OF THE INVENTION

The present invention relates to a new structure of flipper for swimming and a production method for the accomplishment of said flipper.

BACKGROUND OF THE INVENTION

Flippers for swimming are generally produced by injection molding of thermoplastic resins which can be carried out in one step in the case in which, to lower the production costs, the fin and shoe are molded simultaneously, or in at most two successive steps in the case in which the shoe is injected onto a separately molded fin. In the latter case, it is possible to obtain flippers of higher quality since softer materials can be used for the shoe and more rigid ones for the fin. The most commonly used thermoplastic resins are those comprising mainly ethylene/styrene and butylene/styrene for the shoe, and mainly EVA (ethylene-vinyl acetate copolymer) for the fin.

With regard to special flippers such as those made for expert scuba divers, the flippers must be highly technical and comfortable. In this case, a widely used type of flipper comprises a fin in moplen of considerable length and a shoe, made of a mixture composed mainly of natural rubber, anchored to one end of the fin and to its lateral edges by means of ribs extending from it. The shoe differs in hardness in its various parts to accommodate the specific functions that each of them must accomplish: thus, its front part, in contact with the toes, the rear part and the edge delimitating the opening of the shoe are of a soft consistency, whereas the part corresponding to the back of the foot and to the fin connecting ribs is considerably more rigid. This is accomplished in the molding step, using portions of rubber of different hardnesses which, also on the basis of the experience of the operator, are adequately arranged in each part of the mold before vulcanization. With this procedure, high quality flippers, from the standpoint of both performance and comfort, are obtained, but the molding time is relatively long, and, therefore, the productivity is low. Furthermore, due to these molding modalities, limited but perceptible irregularities can occur in the distribution of the differences in the stiffness of the shoe with respect to the optimum distribution, thus involving some localized discomfort for the person wearing the flipper.

With the object of reducing the time and cost of production, the use of rubber has been replaced by that of thermoplastic resins, to realize flipper shoe and ribs by means of injection molding. The flippers that are obtained with this procedure are, however, of lower quality and are also less comfortable with respect to the above described flippers made of rubber. This is because the stiffness of the ribs which extend from the shoe along the sides of the fin affect the stiffness of the shoe itself and, therefore, the resulting stiffness is a compromise between the lesser stiffness with which the shoe should be produced to assure adequate comfort and the greater stiffness which should be used to assure adequate elasticity of the fin.

The object of the present invention is to provide a new production method which makes it possible to obtain, by means of injection molding of all its components, a flipper for swimming with technical characteristics, performance and comfort not lower than those of already known flippers made of natural rubber, but with considerably reduced production time and costs.

A further object of the present invention is to provide a flipper having a new structure to allow the control of the optimal distribution of the various degrees of stiffness of the various components thereof.

SUMMARY OF THE INVENTION

These objects are accomplished with the method according to the invention wherein, first, the fin of the flipper is produced by injection molding as a flat element with one bent end. Then an intermediate element is molded onto the fin comprising a substantially flat part overlapping said bent end, and a substantially arcuate part extending over said flat part and a forked part forming two ribs, each of which extends both above and below said fin, along its side edges. Finally, a shoe is molded onto said intermediate element which lines the internal faces of said flat and arcuate parts. To obtain the maximum productive advantage and the best performance of the product, a single material is used in different mixtures of different hardness for the various components of the flipper.

The flipper for swimming according to the present invention is characterized by the fact that it is composed of three parts molded one after another, each of which has a different stiffness suited to the function it is designed to serve. Said three parts comprise a flipper fin with one end bent to form an obtuse angle with the rest of the fin; an intermediate element comprising a substantially flat part, overlapping said bent end, from which a substantially arcuate part extends over it and a forked part forming two ribs each of which extends both above and below said fin, along its lateral edges; and a shoe on said intermediate element which lines the internal faces of said flat part and arcuate part.

Further characteristics and advantages of the method for the production of a flipper for swimming and of a flipper obtained with the method according to the invention will become apparent in the following description of one of its possible embodiments, given as an example and not limitative, with reference to the attached drawings.

DETAILED DESCRIPTION OF A PREFERRED EMBODIMENT

Figure 1:
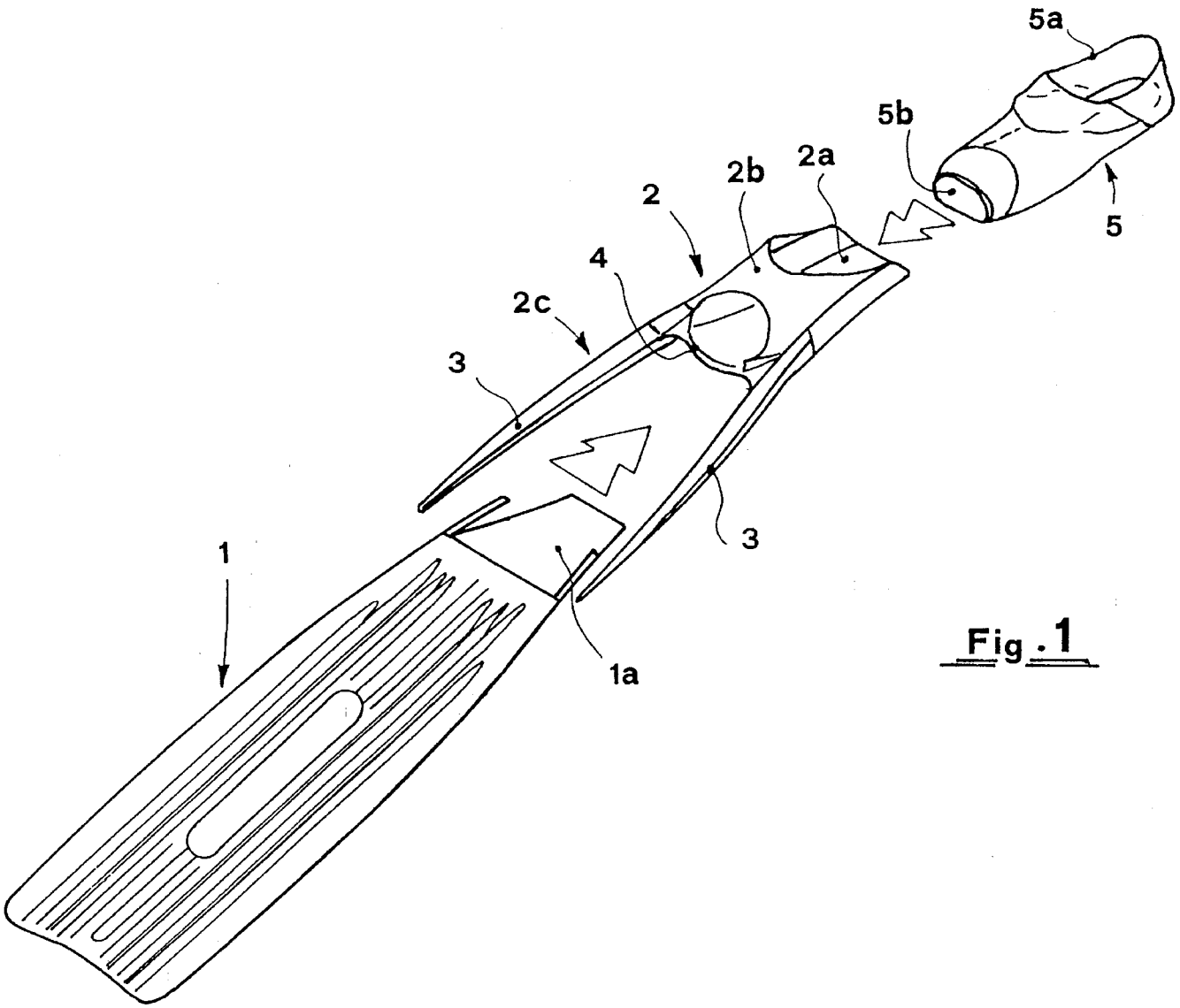
FIG. 1 is an exploded perspective view of the fin according to the invention.
Figure 2:
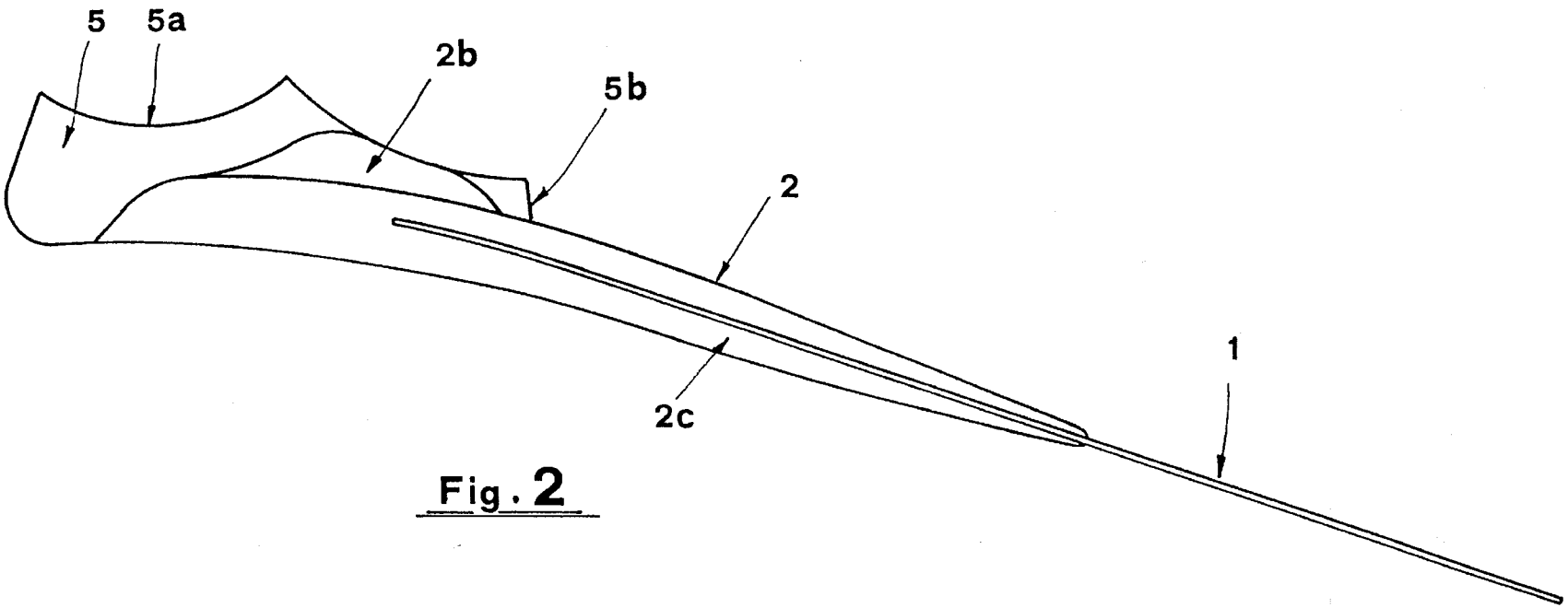
FIG. 2 is a side view of the flipper according to the invention.

With reference to the above-mentioned figures, indicated with 1 is a fin of a flipper having a typical flat development with a shaped free end and an opposite end 1*a* bent to form an obtuse angle with the extended portion of the fin. The bent end 1*a* of fin 1 engages with the substantially flat part 2*a* of an intermediate element generically indicated at 2 and comprising the above-mentioned flat part 2*a* and a portion 2*b* in the form of an arc extending over flat part 2*a* to form a cavity to house the foot against which the arcuate portion 2*b* is destined to abut. From flat part 2*a*, a forked portion 2*c* also extends on a plane that forms, with said flat part 2*a*, an obtuse angle substantially the same as the one which bent end 1*a* of fin 1 forms with the main portion of the fin itself. Forked part 2*c* forms two locking ribs 3 which are both arranged on the upper and lower faces of fin 1 along its side edges, and which are firmly connected to said fin. In correspondence to the front edge of flat part 2*a*, from which ribs 3 extend, the flat part itself has an enlargement 4 which gives it an upward inclination with respect to the horizontal plane for greater comfort in resting the toes.

A shoe 5, finally, is fixed to the internal face of flat part 2*a* and of arcuate portion 2*b* of intermediate element 2, and has a main opening 5*a* for the insertion of the foot and an front opening 5*b*, in correspondence with enlargement 4, from which the toes can protrude.

Figure 3:
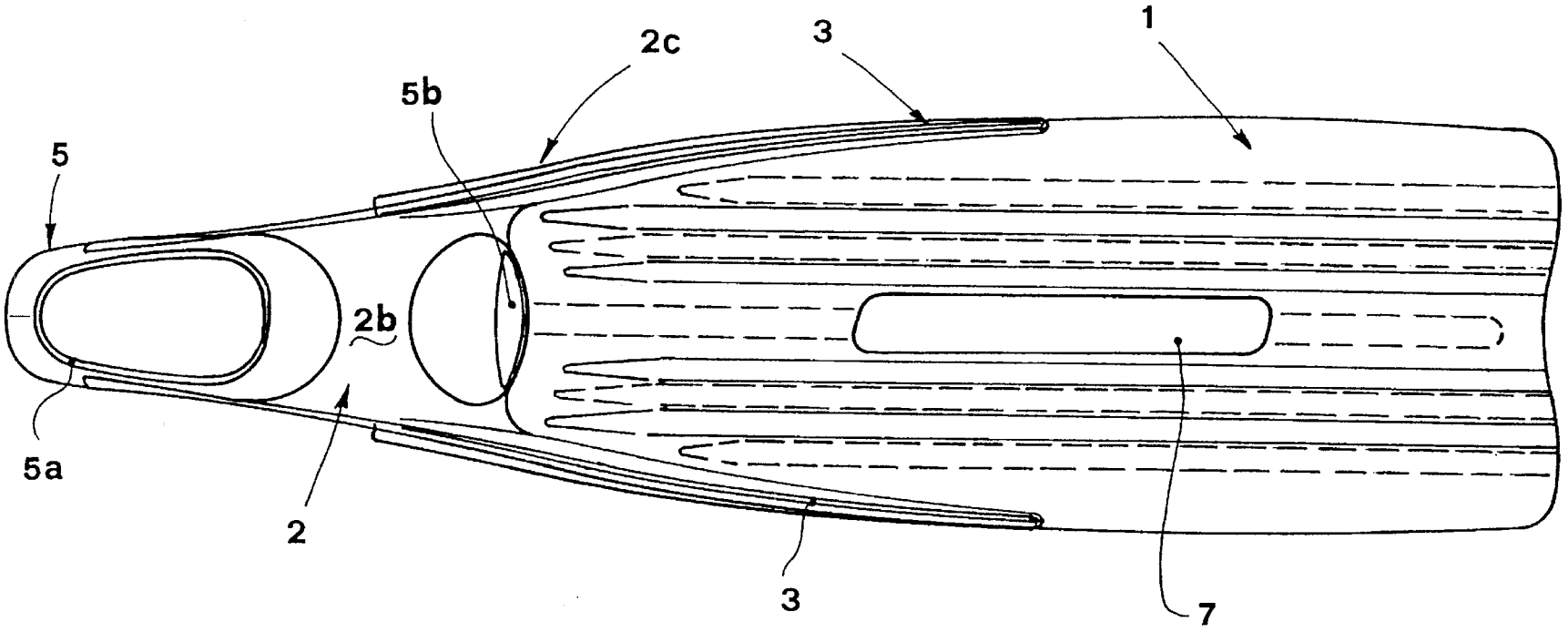
FIG. 3 is a top plan view of the flipper of FIG. 2.
Figure 4:
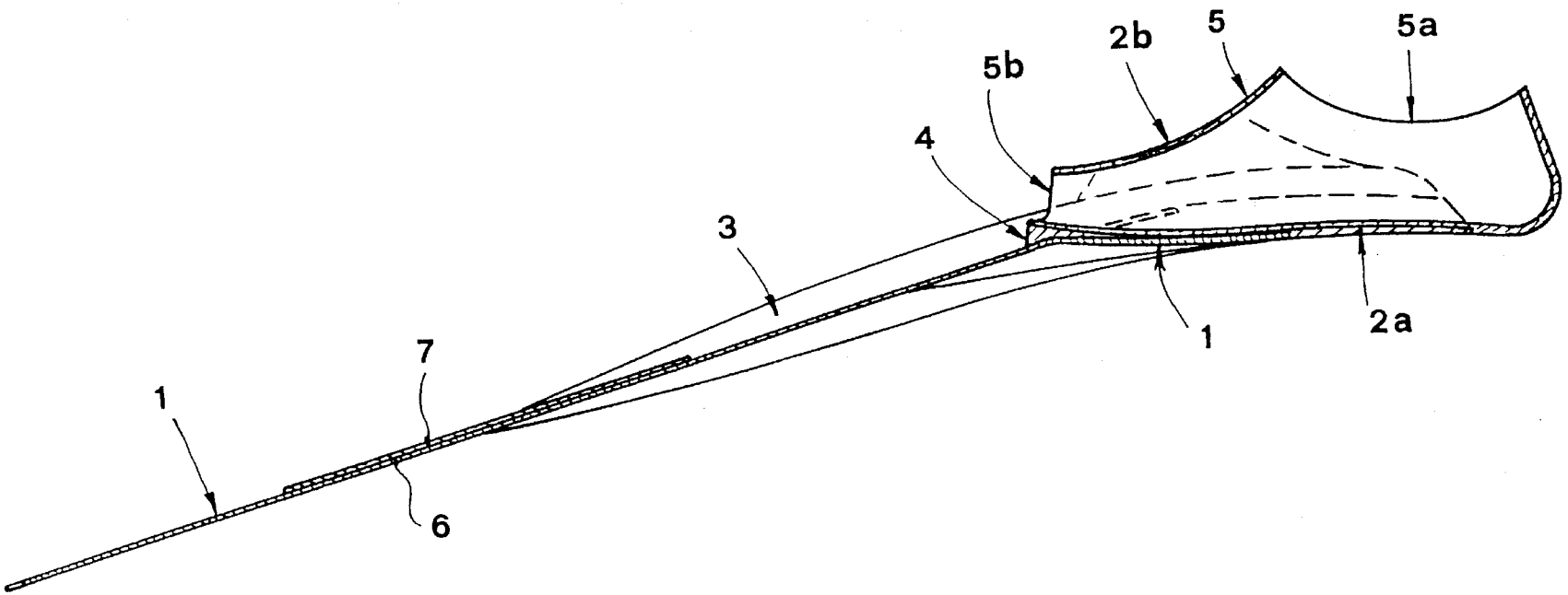
FIG. 4 is an axial longitudinal sectional view of the rear portion of the flipper according to the invention.

Thanks to the structure of flipper illustrated above and using the method of the injection molding, it is possible to provide adequate stiffness to each of the component parts of the flipper by opportunely varying the hardness of the starting mixture fed to the molds. It is thus possible to realize shoe 5 of the flipper in thermoplastic resin of soft consistency to assure the maximum comfort to the parts of the foot in contact with it. By realizing, on the other hand, intermediate element 2 with the same resin but of a different hardness to provide greater stiffness with respect to that of shoe 5, it is possible to make the part of the shoe under the foot as well as that corresponding to the back of the foot itself assume a greater stiffness. Furthermore, ribs 3, being part of intermediate element 2, have a greater stiffness than that of shoe 5, but in such amount to provide the fin with the required elasticity. The fin can be preferably realized with the same polymeric mixture as the other components but with a greater hardness to give it the typical flexible laminar configuration which, associated with the elasticity of ribs 3 located along its lateral edges, assures a high level of efficiency in the flipper thrust. As shown in FIGS. 3 and 4, along the lower face of the fin run longitudinal bands 6 formed in the same material as the shoe during its molding. In the same way also writing 7 is formed on the upper face of the fin.

In the production process of the flipper according to the present invention, the material used for molding is chosen from among the elastomer-containing polyolefinic compounds raised to various degrees of hardness according to whether they are used for molding the shoe, the intermediate element or the fin, for which the choice would fall preferably on propylene-ethylene copolymers. The molding is accomplished in conventional automatic or semiautomatic injection systems available on the market, using the usual additives well-known to technicians in the field.

First, the fin is molded in a first section of the system. By means of conveyor belts, or equivalent transfer means, the fin is inserted in a second mold where the mixture for the formation of the intermediate element is injected. The product is then fed to a third section of the system and mounted on a mold where the mixture for the formation of the shoe is injected.

Due to the compatibility and homogeneity of the resin used, the three parts composing the flipper solder tightly to one another. With a view to increasing the stability of the connection between the ribs extending from the intermediate element 2 and the fin of the flipper, slots can be advantageously formed through the fin near its edges which slots fill with polymer during the molding of the ribs, thus allowing the formation of a single body between the portions of the ribs located on the upper face and those located on the lower face of the fin, i.e. rib parts-joining portions extending through such slots, assuring in that way a perfect anchorage to the fin itself. Furthermore, given that for each component a specific mixture is prepared, it is possible to add any desired dye to each one and, therefore, realize flippers in three colors with an ample variety of choice.

I claim:

1. A flipper for swimming comprising at least three parts molded in succession, each having a different stiffness, said three parts comprising:

a flipper fin with a flat bent end, an intermediate element comprising a substantially flat part overlapping said bent end, a substantially arcuate part extending over it and a forked part extending from said flat part and comprising two ribs each of which is located both above and below said fin along its lateral edges, and a shoe fixed to said intermediate element to line internal faces of said flat part and said arcuate part.

2. Flipper for swimming according to claim 1, wherein said flat bent end of said fin forms an obtuse angle with the rest of the fin and said ribs form substantially the same angle with the substantially flat part of said intermediate element.

3. Flipper according to claim 1, wherein the parts of each rib extending above and below said fin along its lateral edges form a single body having a rib parts-joining portion extending through slots in the fin.

4. Flipper according to claim 1, wherein the substantially flat part of said intermediate element from which the forked part forming said ribs extends, has a front edge in correspondance of which an enlargement is provided for the support of the toes.

5. A flipper for swimming comprising at least three parts, formed of compatible materials and each having a different stiffness, said three parts being joined together and comprising:

a flipper fin with a flat bent end, an intermediate element comprising a substantially flat part overlapping said bent end, a substantially arcuate part extending over said substantially flat part, and a forked part extending from said flat part and comprising two locking ribs each of which is firmly connected to said fin along its lateral edges, and a shoe fixed to said intermediate element to line internal faces of said flat part and said arcuate part.

* * * * *